US005415459A

United States Patent [19]

Schultz

[11] Patent Number: 5,415,459

[45] Date of Patent: May 16, 1995

[54] ADJUSTABLE WIDTH ARM REST

[75] Inventor: Craig H. Schultz, Muscatine, Iowa

[73] Assignee: Hon Industries, Inc., Muscatine, Iowa

[21] Appl. No.: 73,678

[22] Filed: Jun. 8, 1993

[51] Int. Cl.[6] ..... A47C 7/54

[52] U.S. Cl. ..... 297/411.37; 297/411.2

[58] Field of Search ..... 297/411.2, 411.21, 411.26, 297/411.35, 411.37, 115; 248/118

[56] References Cited

U.S. PATENT DOCUMENTS

| | | | |
|---|---|---|---|
| D. 127,281 | 5/1941 | Schreckengost . | |
| D. 261,831 | 11/1981 | Luckey . | |
| D. 279,443 | 7/1985 | Diffrient . | |
| 455,168 | 6/1891 | Case . | |
| 542,390 | 7/1895 | Linn | 297/411.38 X |
| 2,030,635 | 2/1936 | Horwitt et al. . | |
| 2,325,292 | 7/1943 | Westrope . | |
| 2,549,902 | 4/1951 | Hibbard et al. . | |
| 2,760,813 | 8/1956 | Colm . | |
| 2,815,067 | 12/1957 | Richardson . | |
| 3,142,194 | 7/1964 | Garden . | |
| 3,215,470 | 11/1965 | Swenson et al. . | |
| 3,271,073 | 9/1966 | Van Buren, Jr. . | |
| 3,292,972 | 12/1966 | Krueger . | |
| 3,427,054 | 2/1969 | Bergman . | |
| 3,474,993 | 10/1969 | Murcott . | |
| 3,614,156 | 10/1971 | Sarvas . | |
| 3,669,496 | 6/1972 | Chisholm . | |
| 3,669,499 | 6/1972 | Semplonius et al. . | |
| 3,747,976 | 7/1973 | Lacey . | |
| 3,904,242 | 9/1975 | Koepke et al. . | |
| 4,012,158 | 3/1977 | Harper . | |
| 4,036,525 | 7/1977 | Howk . | |
| 4,043,592 | 8/1977 | Fries . | |
| 4,153,296 | 5/1979 | Rhamstine . | |
| 4,159,148 | 6/1979 | Schulz | 297/417 |
| 4,221,430 | 9/1980 | Frobose . | |
| 4,267,748 | 5/1981 | Grunewald et al. . | |
| 4,277,102 | 7/1981 | Aaras et al. . | |
| 4,282,634 | 8/1981 | Krauss . | |
| 4,401,006 | 8/1983 | Sekiguchi . | |
| 4,451,084 | 5/1984 | Seeley . | |
| 4,546,668 | 10/1985 | Mattsson . | |
| 4,557,521 | 12/1985 | Lange . | |
| 4,572,578 | 2/1986 | Perkins . | |
| 4,573,737 | 3/1986 | Korn . | |
| 4,576,351 | 3/1986 | Brink | 297/411.26 X |
| 4,616,877 | 10/1986 | Slaats et al. . | |

(List continued on next page.)

FOREIGN PATENT DOCUMENTS

| | | |
|---|---|---|
| 2505158 | 11/1982 | France . |
| 160465 | 12/1979 | Japan . |

*Primary Examiner*—Kenneth J. Dorner
*Assistant Examiner*—Milton Nelson, Jr.
*Attorney, Agent, or Firm*—Jones, Day, Reavis & Pogue

[57] ABSTRACT

A chair is provided having at least one arm rest which may be laterally adjusted in order to adjust the width between the opposing arm rests and accommodate different size users. The arm rest is attached to the chair arm for lateral movement inboard and outboard of the chair arm. The arm rest is also attached to the chair arm for pivotable movement between a locked position wherein a latch attached to one of the arm rest or the chair arm latchedly engages the other of the arm rest or the chair arm for selectively locking the arm rest in the desired lateral position and an unlocked position for permitting the arm rest to be laterally adjusted. In one embodiment, the arm rest has a latch mechanism which comprises a lower bracket rigidly attached to the chair arm and an upper bracket slidably and pivotably attached to the lower bracket so that the upper bracket pivots between the locked and unlocked positions and may move in the lateral direction relative to the lower bracket in the unlocked portion. The arm rest is attached to the upper bracket so that the arm rest may slide in the lateral direction or pivot between the locked and unlocked positions in cooperation with the upper bracket.

25 Claims, 4 Drawing Sheets

U.S. PATENT DOCUMENTS 4,647,109 3/1987 Christopherson .
4,659,135 4/1987 Johnson .
4,660,885 4/1987 Suhr et al. .
4,660,887 4/1987 Fleming et al. .
4,662,681 5/1987 Favaretto .
4,707,026 11/1987 Johansson .
4,744,603 5/1988 Knoblock .
4,828,323 5/1989 Broderson et al. .
4,856,846 8/1989 Lohmeyer .
4,881,424 11/1989 Clark et al. .
4,892,356 1/1990 Pittman et al. .
4,908,917 3/1990 Kazle .
4,917,438 4/1990 Morgan .
4,961,610 10/1990 Reeder et al. .
5,007,678 4/1991 DeKraker .
5,009,467 4/1991 McCoy .
5,015,038 5/1991 Mrotz, III .
5,143,422 9/1992 Althofer et al. .

ADJUSTABLE WIDTH ARM REST

FIELD OF THE INVENTION

The present invention relates generally to chairs and, more particularly, to chairs having adjustable width arm rests.

BACKGROUND OF THE INVENTION

Chairs may have a pair of opposing chair arms and arm rests in order to provide increased comfort and to decrease fatigue by providing support for the user's arms and lateral support for the body. In some instances, it may be desirable to adjust the width between the arm rests to accommodate different sizes and/or positions of users. However, typical arm rests are rigidly attached to their respective chair arms so that the chair arms must also be adjusted in order to adjust the arm rests. Other arm rests which are adjustable relative to their chair arms use relatively complex mechanisms requiring tools to assemble and disassemble so that it is difficult for the typical user to adjust the width between the arm rests, and the assembly and manufacturing costs are increased.

OBJECTS AND SUMMARY OF THE INVENTION

It is an object of the present invention to provide a novel chair in which a pair of opposing arm rests may be easily and quickly adjusted to accommodate different size and positions of users without the need for tools. It is a related object to provide arm rests which may be laterally positioned to selectively adjust the width between the opposing arm rests.

It is another object of the present invention to provide an arm rest having a latch mechanism which readily permits lateral positioning of the arm rest.

Another object of the present invention is to provide an arm rest having a latch mechanism which is reliable, simple and easily manufactured.

It is an associated object to provide a latch mechanism which not only locks the arm rest in the desired lateral position but also permits the arm rest to be easily unlocked and repositioned laterally.

A further object of the present invention is to provide an adjustable arm rest which can be adapted to existing chairs.

The present invention is generally directed to a chair having at least one arm rest which has unique structural features to permit the lateral position of the arm rest to be quickly and easily adjusted without the need for tools. The arm rest is attached to the chair arm for lateral movement inboard and outboard of the chair arm. The arm rest is also attached to the chair arm for pivotable movement between a locked position wherein a latch attached to one of the arm rest or the chair arm latchedly engages the other of the arm rest or the chair arm for selectively locking the arm rest in the desired lateral position and an unlocked position for permitting the arm rest to be laterally adjusted.

In one embodiment, the arm rest has a latch mechanism which comprises a lower bracket rigidly attached to the chair arm and an upper bracket slidably and pivotably attached to the lower bracket so that the upper bracket may move in the lateral direction relative to the lower bracket and pivot between locked and unlocked positions. The arm rest is attached to the upper bracket so that the arm rest may slide in the lateral direction and pivot between the locked and unlocked positions in cooperation with the upper bracket. A latch is attached to the upper bracket to latchedly engage a plurality of notches disposed in the lower bracket in the locked position so as to prevent lateral movement between the brackets until the upper bracket is intentionally pivoted to the unlocked position.

These and other features and advantages of the invention will be more readily apparent upon reading the following description of embodiments of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
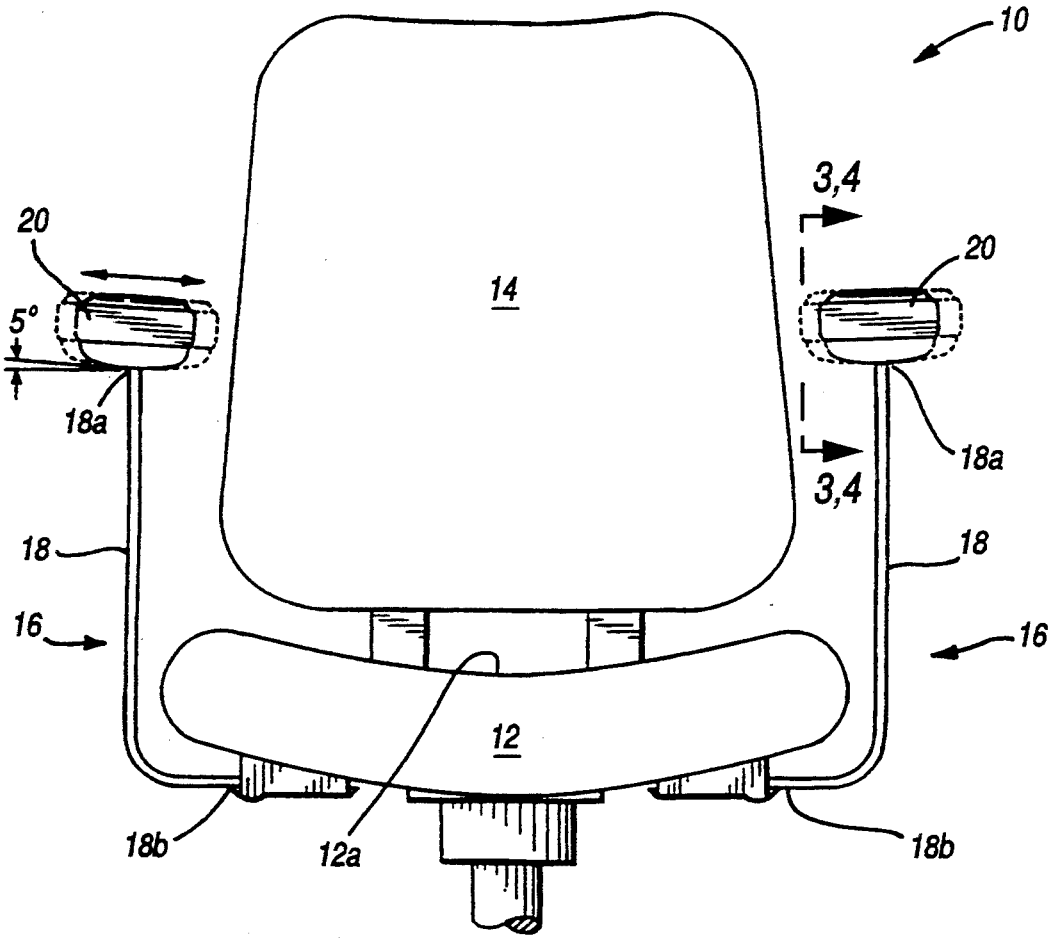
FIG. 1 is a front view of part of a chair including a pair of opposing chair arms and arm rests and showing each arm rest in different lateral positions in phantom lines.

Referring to FIG. 1, there is shown a front view of part of a chair 10 including a chair seat 12, a back rest 14, a pair of opposing chair arms 16 and arm rests 20 in accordance with the present invention. The chair seat 12 has a top surface **12*a* to permit a user to sit between the opposing chair arms 16 and arm rests 20. Each chair arm 16 typically has a generally vertical support bar 18 and an arm rest 20 at the top 18*a* of the support bar 18. The lower portion 18*b* of the support bar 18 is adapted to be attached to the chair seat 12 in order to support the arm rest 20** in the desired position and orientation with respect to the user.

In accordance with one of the objects of the invention, at least one and preferably both arm rests 20 are operatively attached to the support bar 18 so that each arm rest 20 may be selectively and individually adjusted to accommodate different sizes and/or positions of users. Each arm rest 20 may be adjusted in the lateral direction as indicated by the arrows and phantom lines in FIG. 1 in order to adjust the width between the arm rests 20. The arm rests 20 are also operatively attached to the support bar 18 for movement between a first or locked position for selectively locking each arm rest 20 in the desired lateral position and a second or unlocked position for permitting the lateral position of each arm rest 20 to be readily adjusted. A latch is attached to the arm rest 20 or support bar 18 for engaging the other of the arm rest 20 or support bar 18 in order to prevent the arm rest 20 from being laterally positioned until the latch is intentionally unlocked.

Figure 3:
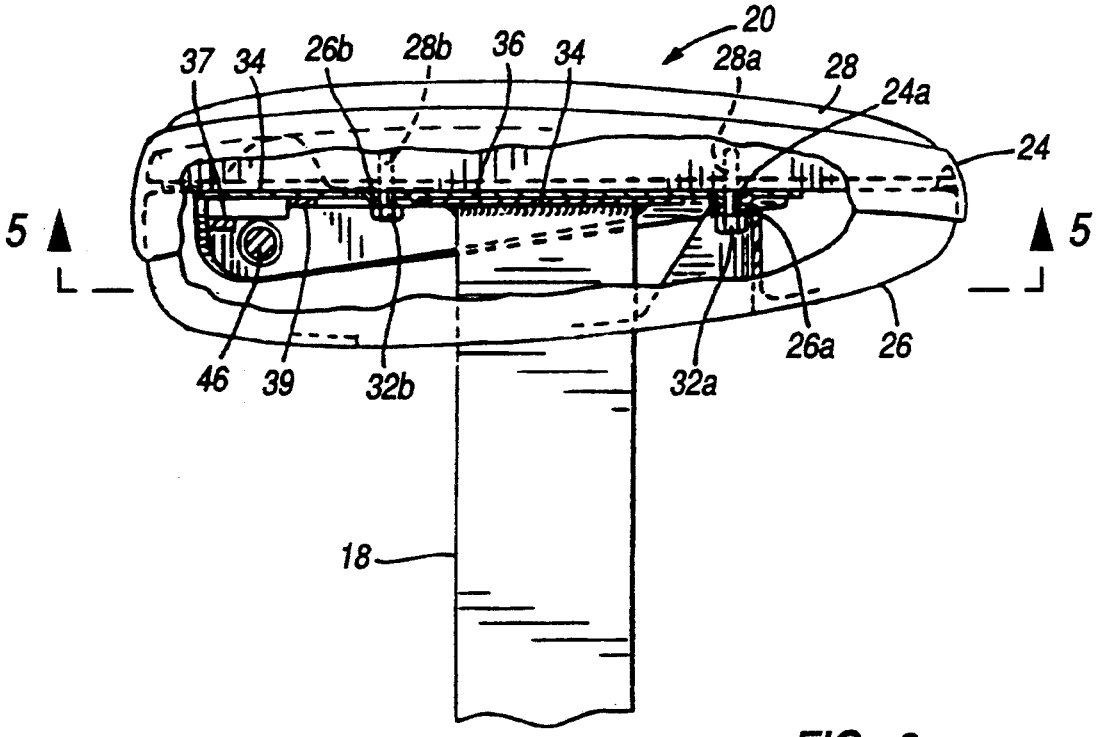
FIG. 3 is a partial cross-sectional side view of the arm rest and the latch mechanism in a first or locked position taken along line 3—3 in FIG. 1.
Figure 4:
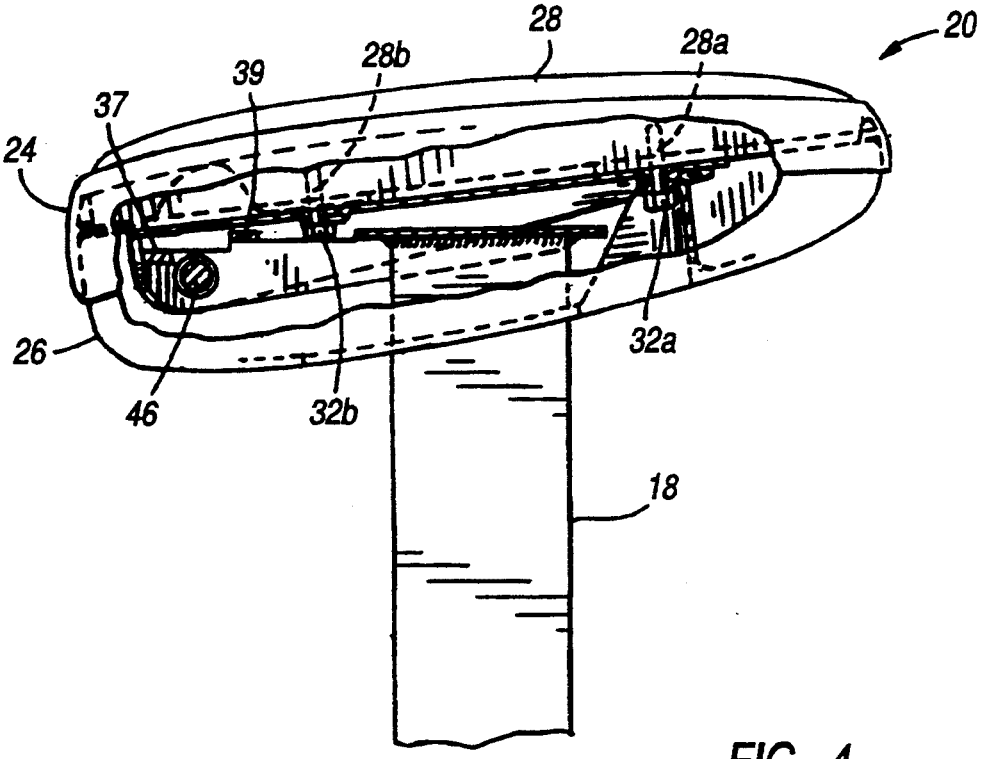
FIG. 4 is a partial cross-sectional side view of the arm rest and the latch mechanism in a second or unlocked position taken along line 4—4 in FIG. 1.
Figure 5A:
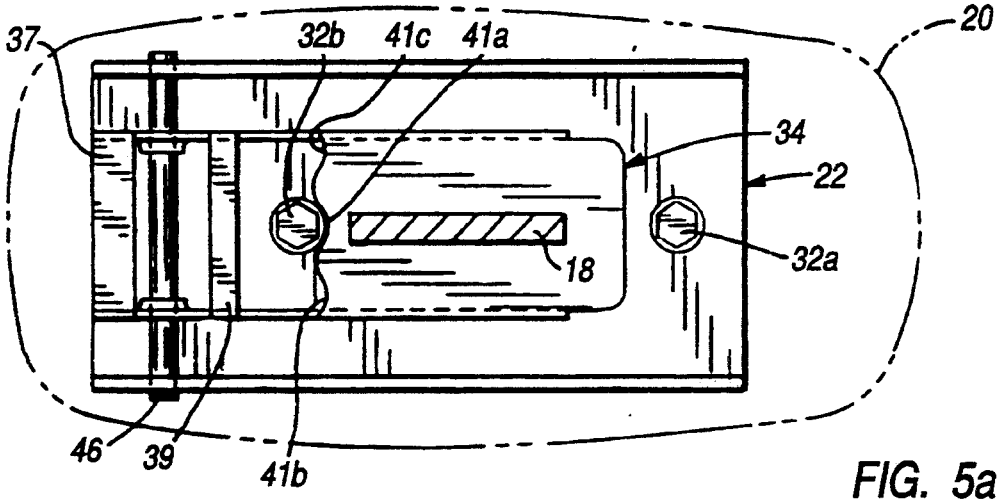
FIG. 5A is a bottom view of the latch mechanism, taken along line 5—5 in FIG. 3 showing the arm rest in a middle position.
Figure 5B:
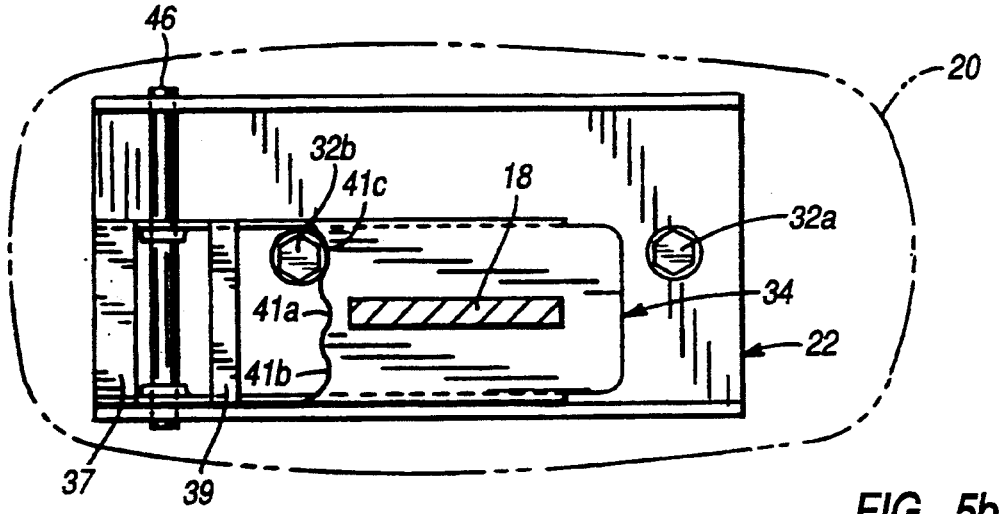
FIG. 5B is a bottom view of the latch mechanism taken along line 5—5 in FIG. 3 showing the arm rest in the inboard position.
Figure 5C:
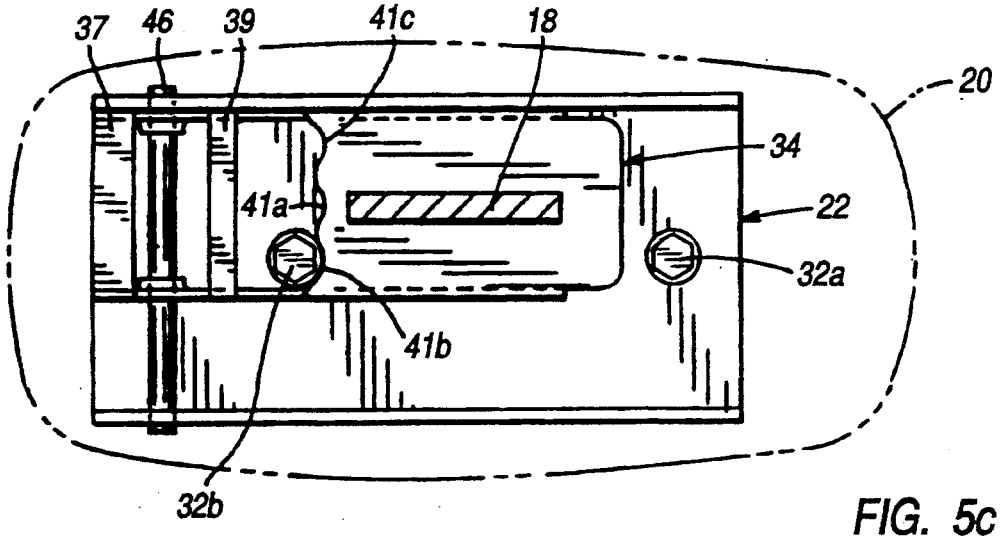
FIG. 5C is a bottom view of the latch mechanism taken along line 5—5 in FIG. 3 showing the arm rest in the outboard position.

In the illustrated embodiment, each arm rest 20 has a latch mechanism 22 which permits the arm rest 20 to be selectively adjusted and which holds the arm rest 20 in a desired position. The latch mechanism 22 enables the arm rest 20 to move laterally inboard and outboard of the support arm 18 as shown by the arrow and broken lines in FIG. 1 and also to pivot between the first or locked position (FIG. 3) and a second or unlocked position (FIG. 4). In the locked position shown in FIG. 3, the latch mechanism 22 holds the arm rest 20 in the desired lateral position. In the unlocked position shown in FIG. 4, the latch mechanism 22 permits the arm rest 20 to be adjusted in the lateral direction.

Figure 2:
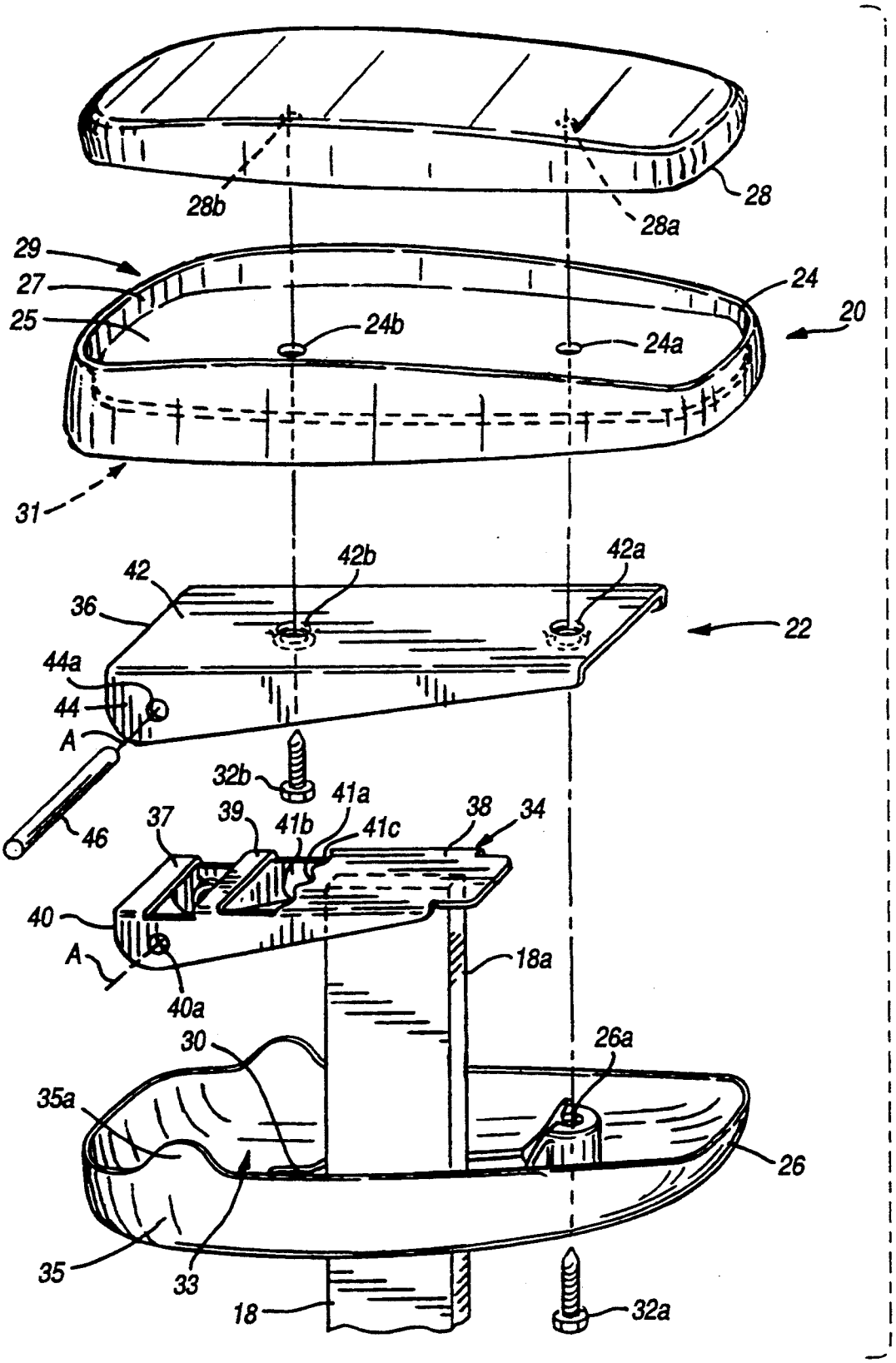
FIG. 2 is an exploded perspective view of an arm rest and latch mechanism in accordance with a preferred embodiment employing teachings of the present invention.

FIG. 2 illustrates an exploded view of one embodiment of the arm rest 20 and the latch mechanism 22. The latch mechanism 22 has lower and upper brackets 34, 36 which are slidably and pivotably attached to each other. The lower bracket 34 has a substantially flat base 38 and two opposing sides or flanges 40 defining a channel-shaped cross section. The lower bracket 34 may be rigidly attached to the support bar 18 by any method sufficient to maintain them in a stationary relationship relative to each other and which provides a sturdy base for supporting the upper bracket 36 and the arm rest 20. Since each arm rest 20 is preferably designed to support 300 pounds, welding the bracket 34 and support bar 18 together is one of the preferred methods. Bridge members 37, 39 disposed at the rear of the lower bracket 34, in spaced relation to one another and to the rear edge of base 38, provide reinforcing support for the bracket 34. Referring to FIGS. 3–4 it will be seen that the front bridge 39 is in the same plane as the base 38 and that the rear bridge 37 is below said plane.

The base 38 of lower bracket 34 has a plurality of arcuate shaped notches 41 disposed in the rear edge of the center of the base 38 and which thereby provide abutment notches at each side of each notch. In the illustrated embodiment, the base 38 has three notches: a center notch **41*a* centrally located over the support bar 18 and notches 41*b*, 41*c* disposed inboard and outboard of the support bar 18, respectively. It is preferred that the notches 41 be spaced apart in about ½ inch increments for reasons which will be discussed in greater detail below. It will be appreciated that the inboard and outboard positions 41*b*, 41*c* are mirror images of one another for the left and right arm rests 20. In order to simplify the figures, it will be assumed that the left arm rest is shown in FIGS. 2–5*c* and that the inboard and the outboard positions are located at the bottom and the top of the figures, respectively. The operation of the left and right arm rests 20** are otherwise the same, being mirror images of one another.

The upper bracket 36 also has a channel-shaped cross-section defined by a base 42 and two opposing sides or flanges 44. In the illustrated embodiment, the sides 40 of the lower bracket 34 are adapted to fit between the upper bracket's sides 44. In order to slidably and pivotably attach the upper and lower brackets 36, 34, the bracket sides 40, 44 have respective holes **40*a*, 44*a* which cooperate with pin 46 to mount the pin on bracket 36 and permit the upper bracket 36 to slide along pin 46 between a center position shown in FIG. 5*a*, an outboard position shown in FIG. 5*b*, and an inboard position shown in FIG. 5*c*. It will be appreciated that the sides 44 of the upper bracket act to limit the lateral movement of the upper bracket along the pin 46. In another embodiment (not shown), the lower bracket's sides 40 may project upwardly and be adapted to receive the upper bracket 36** therebetween and limit the lateral movement thereof.

The upper bracket 36 also is pivotable about pin 46 between the first or locked position shown in FIG. 3 and the second or unlocked position shown in FIG. 4. The front bridge 39 and base 38 support the upper bracket 36 in the locked position as shown in FIG. 3. Referring to FIG. 4, it will be seen that the rear bridge 37 acts as a stop to limit the counterclockwise rotation of the upper bracket 36 to the unlocked position. In the unlocked position, the rear bridge 37 also provides supplemental support and a guide for the lateral sliding movement of the bracket 36 along the pin 46.

The arm rest 20 is attached to the upper bracket 36. The attached arm rest 20, in cooperation with the upper bracket 36, may slide laterally between the inboard and outboard positions and pivot between the locked and unlocked positions. Referring to FIG. 2, it will be seen that the arm rest 20 includes a padded, substantially flat portion 28, and upper and lower housing portions 24, 26 which are adapted to attach to the bracket 36 so as to form a housing which encloses the latch mechanism 22 and prevents the user from inadvertent engagement in the moving components of the latch mechanism 22. The upper and lower portions 24, 26 are preferably formed of molded plastic although they may be made of any other suitable material which will provide a durable housing and adequate structural strength so that the arm rest may be attached to the latch mechanism 22. The padded portion 28 is affixed to the upper housing portion 24 and may be formed of any suitable material which provides a comfortable support for the user, including for example, soft urethane or wood.

In the illustrated embodiment, the upper housing 24 has a base 25 and side wall 27 forming a top pocket or recess 29 adapted to receive the padded portion 28 and a bottom opening 31 adapted to receive the latch mechanism 22. The side wall 27 also protects the padded portion from scuffing and wear. The lower housing 26 has a cup-shaped base 33 forming a slot 30 adapted to slidably engage the support bar 18 and a side wall 35 adapted to engage the side wall of top housing 24 around its bottom aperture 31 to form the housing for the latch mechanism 22. Upwardly extending rear protuberances **35*a* form spacers to insure that there is sufficient clearance between the upper and lower portions 24, 26 for the latch mechanism 22. The left and right protuberances 35*a* also act to capture the pin 46 therebetween so as to prevent the pin 46 from inadvertently sliding out of the lower and upper brackets 34, 36**.

In order to attach the arm rest 20 to the latch mechanism 22, the upper housing base 25 is adapted to engage the upper bracket 36 and has a plurality of screw holes **24*a*, 24*b* corresponding to screw holes 42*a*, 42*b*, respectively, in the base 42 of the upper bracket 36. The lower housing base 25 also has a screw hole 26*a* corresponding to screw holes 24*a*, 28*a*, 42*a* to receive a securing screw 32*a*. Holes 28*b*, 24*b*, and 42*b* cooperate with screw 32*b* to attach the padded portion 28 and upper arm rest portion 24 to the bracket 36. Similarly, holes 28***a*, 24*a*, 42*a* and 26*a* cooperate with screw 32*a* to attach the arm rest portions 24, 26 to the bracket 36 and to each other. In order to permit the arm rest 20 to slide and pivot relative to the support bar 18, it will be appreciated that the lower arm rest portion 26 cannot be anchored to the stationary lower bracket 34 or support bar 18. Thus, the lower portion 26 of the arm rest 20 is only attached to the upper bracket 36 and the upper housing 24, as by screw 32*a*. The slot 30 in the lower portion 26 permits the arm rest 20 to slide and pivot relative to the rigidly mounted support bar 18, lower bracket 34 and chair seat 12 and, of course, the user sitting in the chair seat 12. Other methods will be known to those skilled in the art for assembling the arm rest 20 to the latch mechanism 22. For example, it is preferred that the padded portion 28 be formed of a separate resilient section which may be secured to the aperture 29 in the upper portion 24, but it may also be integrally formed with the upper portion 24. Similarly, the arm rest 20 and the upper bracket 36 may also be formed as a single integral piece made of metal, plastic or other suitable material capable of slidably and pivotably attaching to the lower bracket 34.

In order to hold the attached arm rest 20 and upper bracket 36 in a desired lateral position, a latch is attached to one of the upper or lower brackets 34, 36 to latchedly engage the other of the brackets 34, 36 so as to prevent movement therebetween. It is preferred that the latch be attached to the upper bracket 36 and be adapted to latchedly engage one of the arcuate shaped notches 41 formed in the lower bracket's base 38 in the locked position (FIG. 3). In the illustrated embodiment, the latch is defined by the head of screw 32*b* used to attach the upper portion 24 of the arm rest 20 and upper bracket 36 but in other embodiments (not shown) the latch may be defined by another protuberance adapted to latchedly engage the notches 41. When the head 32*b* latchedly engages one of the notches 41 in the locked position, as shown in FIG. 3, it prevents lateral movement of the arm rest 20 unless the head 32*b* is first disengaged from the notches 41. In order to position the arm rest 20 laterally, the arm rest 20 must be pivoted about pin 46 from the locked position (FIG. 3) to the unlocked position (FIG. 4) so as to disengage the screw head 32*b* from the notches 41, wherein the arm rest 20 may be slidably positioned along the pin 46 to the desired lateral position. In order to hold the arm rest 20 in the selected lateral position, the arm rest 20 is pivoted from the unlocked position (FIG. 4) back to the locked position (FIG. 3) wherein the head 32*b* reengages one of the notches 41.

In order to assemble and operate the width adjustable arm rest 20, the vertical portion of the support bar 18 is slidably inserted into the slot 30 disposed in the lower housing portion 26. The lower bracket 34 is rigidly attached to the vertical portion 18*a* to form a rigid and sturdy base for the arm rest 20 and the upper bracket 36 by any suitable method including, for example, welding or the like. Once the support bar 18 is attached to the chair seat 12 by any conventional method, the support bar 18 and the lower bracket 34 will be stationary relative to the seat 12 and the user seated therein. Since it is preferred that each arm rest be slightly inclined (about 5 degrees) inwardly to accommodate the ergonomic needs of the user (as shown in FIG. 1), the lower bracket is preferably welded to the support bar to provide the desired inclination. In other embodiments, the inclination may be obtained by molding the shape of the arm rest or the padded portion.

The upper bracket 36 is attached to the lower bracket 34 for sliding and pivoting movement by aligning the respective holes 40*a*, 44*a* located in the sides 40, 44 of the brackets 34, 36 and inserting pin 46 therein. It will be appreciated that the upper bracket 36 may be pivoted about pin 46 between the locked position shown in FIG. 3 and the unlocked position shown in FIG. 4. In the unlocked position, the upper bracket 36 may slide along pin 46 between inboard and outboard positions (shown in FIGS. 5*b* and 5*c*).

In order to attach the arm rest 20 to the upper bracket 36, the pad portion 28 and the upper portion 24 of the arm rest 20 are positioned adjacent to the upper bracket 26 so as to align holes 42*b*, 24*b*, 28*b* and permit screw 32*b* to fixedly secure the three units together as a single arm rest unit. Similarly, lower arm rest portion 26 is slidably positioned along the support bar 18 so that holes 26*a*, 42*a*, 24*a*, 28*a* are adjacently aligned. Screw 32*a* fixedly secures the forward portion of the arm rest 20 to the upper bracket 36. It will be appreciated that the arm rest 20 will now be carried to slide in the lateral direction and pivot in unison with the upper bracket 36.

In the illustrated embodiment, the head of screw 32*b* defines the latch which latchedly engages the notches 41 disposed in the lower bracket 34 and prevents lateral movement of the arm rest 20. Therefore, in order to selectively position each arm rest 20, the user rotates the arm rest 20 and the connected upper bracket 36 to the raised, unlocked position shown in FIG. 4 so that the latch 32*b* is disengaged from the notches 41, thereby permitting the upper portion 36 and arm rest 20 to slide along pin 46 to the desired lateral position. In order to hold the arm rest 20 in a desired position, the arm rest 20 is rotated to the lower, locked position shown in FIG. 3 so that the latch defined by the screw head 32*b* latchedly engages the notches 41 which prevents further lateral movement. In the illustrated embodiment, each arm rest 20 has three lateral positions: a center position located substantially over the support bar 18 and inboard and outboard positions relative to support bar 18. Thus, the maximum width between the opposing arm rests 20 occurs when both arm rests 20 are positioned in their outboard positions and the minimum width occurs when both arm rests are positioned in their inboard positions. In practice, it has been found that spacing each notches 41 at about ½ inch increments apart so as to yield a 1 inch range of motion for each individual arm rest 20 will meet most ergonomic needs.

Thus, it will be seen that adjustable arm rests and related chair structures have been provided which attain the aforenoted objects. Various additional modifications of the embodiments of the invention specifically illustrated and described herein will be apparent to those skilled in this art, particularly in light of the teachings of this invention.

I claim as my invention:

1. A chair arm comprising:

an arm rest operatively attached to said chair arm for lateral movement inward and outward relative to said chair arm and means for pivotable movement of said arm rest between a locked position wherein said arm rest is selectively locked in a desired lateral position and an unlocked position wherein said arm rest may be laterally adjusted.

2. A chair arm as in claim 1 comprising a latch attached to one of said chair arm and said arm rest which latchedly engages the other of said chair arm and said arm rest in the locked position for preventing lateral movement therebetween and which is disengaged from the other of said chair arm and arm rest when said arm rest is pivoted to the unlocked position.

3. A chair arm as in claim 1 comprising a latch mechanism having a lower bracket fixed to said chair arm and an upper bracket slidably and pivotably attached to said lower bracket so that said upper bracket may pivot between the locked and unlocked positions and move in the lateral direction relative to said lower bracket in said unlocked position.

4. A chair arm as in claim 3 wherein said arm is attached to said upper bracket means for pivotable movement of said arm rest permitting said arm rest to slide in said lateral direction or pivot between said locked and unlocked positions in cooperation with said upper bracket.

5. A chair arm as in claim 3 wherein said arm rest is attached to said chair arm so as to be inclined inwardly.

6. A chair arm as in claim 3 wherein said arm rest has upper and lower housing portions which define a housing for enclosing said latch mechanism therein.

7. A chair arm as in claim 6 wherein said upper housing portion is attached to said upper bracket and said lower housing portion is attached to said upper housing portion.

8. A chair arm as in claim 6 wherein said upper housing portion is adapted to receive a resilient arm rest portion.

9. A chair arm as in claim 6 wherein said lower housing portion has a slot adapted to slidably receive the chair arm.

10. A chair arm as in claim 3 wherein said latch mechanism comprises a latch attached to one of said brackets which latchedly engages the other of said brackets in said locked position and which is disengaged from the other of said brackets when said upper bracket is pivoted to said unlocked position.

11. A chair arm as in claim 10 wherein said arm rest is attached to said upper bracket by at least one screw and said screw defines said latch.

12. A chair arm as in claim 10 wherein the other of said brackets has a plurality of notches adapted to receive said latch therein and to prevent unintentional movement of said arm rest in said lateral direction.

13. A chair arm as in claim 12 comprising one center notch and inboard and outboard notches.

14. A releasable latch mechanism for attaching an arm rest to a chair arm, said latch mechanism comprising:

an upper bracket affixed to an arm rest and operatively attached to a chair arm for lateral movement and for pivotable movement between locked and unlocked positions, a latch element attached to one of said bracket and said chair arm and disposed to latchedly engage the other of said bracket and said chair arm for locking arm rest in said desired lateral position when said upper bracket is in said locked position and to be disengaged from the other of said bracket and said chair arm when said upper bracket is in said unlocked position for permitting said arm rest to be laterally adjusted.

15. A latch mechanism as in claim 14 wherein said chair arm has a lower bracket adapted to slidably and pivotably receive the upper bracket.

16. A latch mechanism as in claim 15 wherein the latch element is attached to one of the upper and lower brackets for latchedly engaging the other of said brackets.

17. A latch mechanism as in claim 16 wherein the other of said brackets has a plurality of notches adapted to receive said latch element therein and prevent unintentional movement of said arm rest in laterally until said arm rest is pivoted to said unlocked position.

18. A latch mechanism as in claim 16 wherein the upper bracket has two sides which receive the lower bracket therebetween and thereby limit the lateral movement of said upper bracket.

19. A latch mechanism as in claim 14 wherein said arm rest has upper and lower housing portions which define a housing for enclosing said latch mechanism therein.

20. A latch mechanism as in claim 19 wherein said upper housing portion is attached to said upper bracket and said lower housing portion is attached to said upper housing portion.

21. A chair comprising:

a pair of opposing chair arms, at least one chair arm having an arm rest for lateral movement inward and outward relative to said chair arm and means for pivotable movement of said arm rest between a locked position wherein said arm rest is selectively locked in a desired lateral position and an unlocked position wherein said arm rest may be laterally adjusted.

22. A chair as in claim 21 wherein each of said chair arms has an associated arm rest.

23. A chair as in claim 22 wherein each associated arm rest and chair arm comprises a latch element attached to one of said chair arm and said arm rest which latchedly engages the other of said chair arm and said arm rest in the locked position for preventing lateral movement therebetween and which is disengaged from the other of said chair arm and arm rest when said arm rest is pivoted to the unlocked position.

24. A chair as in claim 23 comprising a latch mechanism having a lower bracket fixed to said chair arm and an upper bracket slidably and pivotably attached to said lower bracket so that said upper bracket may pivot between the locked and unlocked positions and move in the lateral direction relative to said lower bracket in said unlocked position.

25. A chair as in claim 24 wherein said latch mechanism comprises said latch element attached to one of said brackets which latchedly engages the other of said brackets in said locked position and which is disengaged from the other of said brackets when said upper bracket is pivoted to said unlocked position.

* * * * *